US005481067A

United States Patent [19]

Shibukawa

[11] Patent Number: 5,481,067

[45] Date of Patent: Jan. 2, 1996

[54] ELECTRONIC MUSICAL INSTRUMENT UNDER CONTROL OF MULTIPLE TASK REQUIREMENT

[75] Inventor: Takeo Shibukawa, Hamamatsu, Japan

[73] Assignee: Yamaha Corporation, Japan

[21] Appl. No.: 25,698

[22] Filed: Mar. 3, 1993

[30] Foreign Application Priority Data

Mar. 4, 1992 [JP] Japan ..... 4-047087

[51] Int. Cl.[6] ..... G10H 5/02

[52] U.S. Cl. ..... 84/659; 84/622

[58] Field of Search ..... 84/622, 629, 659

[56] References Cited

U.S. PATENT DOCUMENTS

| | | | |
|---|---|---|---|
| 4,922,796 | 5/1990 | Kondo et al. | 84/622 X |
| 5,040,448 | 8/1991 | Matsubara et al. | 84/622 |
| 5,270,477 | 12/1993 | Kawashima | 84/622 |
| 5;280,129 | 1/1994 | Yamamori et al. | 84/656 X |
| 5,340,938 | 8/1994 | Sugita et al. | 84/622 X |

FOREIGN PATENT DOCUMENTS 4-499 1/1992 Japan .

*Primary Examiner*—William M. Shoop, Jr.
*Assistant Examiner*—Jeffrey W. Donels
*Attorney, Agent, or Firm*—Graham & James

[57] ABSTRACT

An electronic musical instrument having a plurality of first operation elements arranged to be operated for designating a tone pitch of a musical tone to be produced, a plurality of second operation elements arranged to be operated for selecting a tone color of the musical tone, and a musical tone signal production circuit to be applied with a first data indicative of operation of the first operation elements and a second data indicative of operation of the second operation elements, wherein a timer-interrupt signal is generated at a predetermined time interval, a first task requirement flag for processing the first data is set in response to the timer-interrupt signal, and a second task requirement flag for processing the second data is set at each time when the first task requirement flag is plural times, and wherein the first data is applied to the musical tone signal production circuit in dependence upon the first task requirement flag, and the second data is applied to the musical tone signal production circuit in dependence upon the second task requirement flag.

5 Claims, 8 Drawing Sheets

ELECTRONIC MUSICAL INSTRUMENT UNDER CONTROL OF MULTIPLE TASK REQUIREMENT

BACKGROUND OF THE INVENTION

1. Field of the Invention

The present invention relates to an electronic musical instrument designed to produce a musical tone signal in response to operation of a plurality of performance elements, and more particularly to an electronic musical instrument of the type which includes a computer programmed to control production of the musical tone signal.

2. Discussion of the Prior Art

In such a conventional electronic musical instrument as described above, the computer is designed to transfer a key data indicative of tone pitch designated by operation of key switch and an operation element data indicative of a tone color and a sound effect selected by a panel switch to a plurality of musical tone signal forming channels of a musical tone signal production circuit. Under control of the computer, it is required to quickly transfer the key data to the musical tone signal forming channels prior to transfer of the operation element data. To satisfy such a requirement, disclosed in Japanese Patent Laid-open Publication No. 4-499 is an electronic musical instrument wherein the key data and the operation element data are temprorarily stored in a data buffer of the computer and assorted in a priority order to be transferred to the musical tone signal forming channels. In the musical instrument, however, the control program of the computer is complicated due to such assortment of the key data and the operation element data in the data buffer.

SUMMARY OF THE INVENTION

It is, therefore, a primary object of the present invention to provide an improved electronic musical instrument wherein the computer is programmed in a simple manner to quickly transfer the key data to the musical tone signal forming channel prior to transfer of the operation element data.

According to the present invention, the primary object is attained by providing an electronic musical instrument having a plurality of first operation elements arranged to be operated for designating tone pitch of a musical tone to be produced, a plurality of second operation elements arranged to be operated for selecting a tone color of the musical tone, and a musical tone signal production circuit to be applied with a first data indicative of operation of the first operation elements and a second data indicative of operation of the second operation elements, which comprises a timer for generating a timer-interrupt signal at a predetermined time interval; setting means for setting a first task requirement flag for processing the first data in response to the timer-interrupt signal and for setting a second task requirement flag for processing the second data at each time when the first task requirement flag is set plural times; and means for applying the first data to the musical tone signal production circuit based on the first task requirement flag and for applying the second data to the musical tone signal production circuit based on the second task requirement flag.

BRIEF DESCRIPTION OF THE DRAWINGS

Additional objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
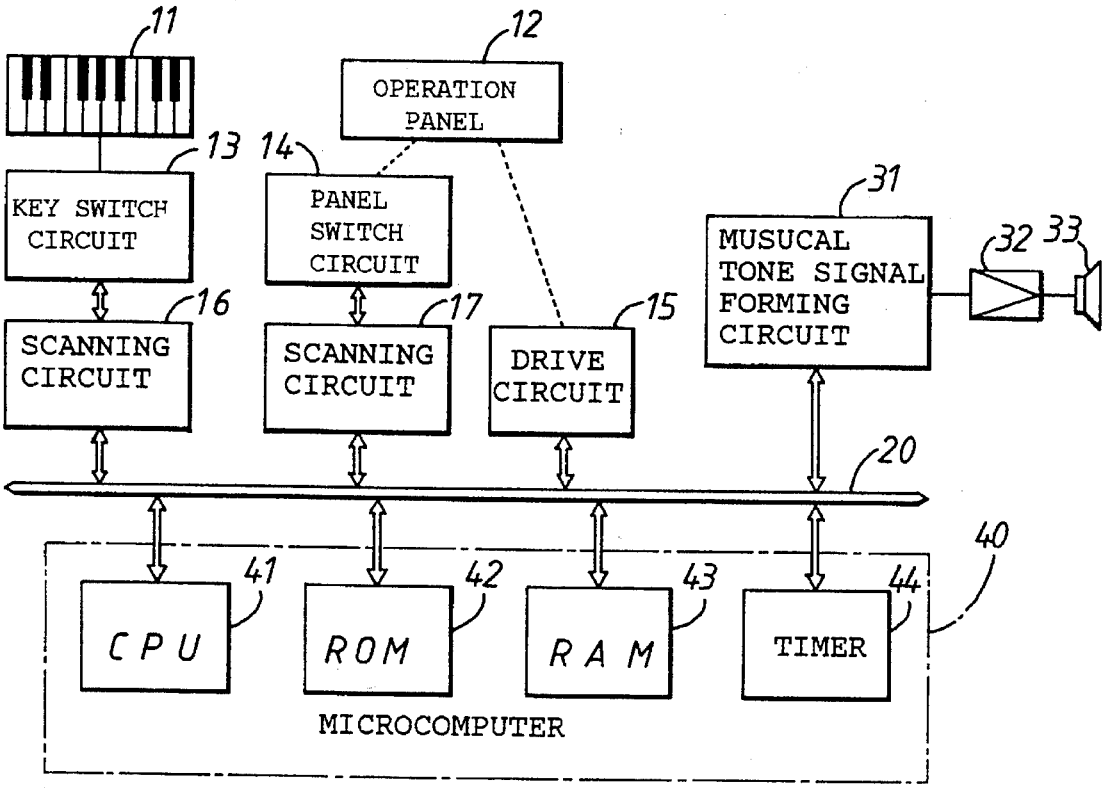
FIG. 1 is a block diagram of a preferred embodiment of an electronic musical instrument according to the present invention.

In FIG. 1 of the drawings, there is diagrammatically illustrated an electronic musical instrument provided with a key board 11 and an operation panel 12, The key-board 11 has a plurality of keys arranged to be operated for designating tone pitch of a musical tone signal to be produced. Connected to the key-board 11 is a key switch circuit 13 which includes a plurality of key switches arranged to detect each depression or release of the keys and a plurality of key-touch detectors arranged to detect each touch of the keys. The operation panel 12 is provided with a plurality of operation elements for selecting a tone color of the musical tone, a plurality of operation elements for selecting a sound effect to be applied to the musical tone, and a plurality of light emitting elements for indicating a selected condition of the tone color and sound effect. Connected to the operation panel 12 is an operation switch circuit 14 which includes a plurality of operation switches arranged to detect each operation of the operation elements. The light emitting elements are arranged to be energized or deenergized under control of a drive circuit 15. A first scanning circuit 16 is arranged to scan the respective key switches and touch detectors in the key switch circuit 13, and a second scanning circuit 17 is arranged to scan the respective operation switches in the panel switch circuit 14.

The drive circuit 15 and scanning circuits 16, 17 are connected in common to a bus line 20 to which connected are a musical tone signal production circuit 31 and a microcomputer 40. The musical tone signal production circuit 31 has a plurality of musical tone signal forming channels the number of which is less than that of the keys. The musical tone signal forming channels each are arranged to produce a musical tone signal therefrom. The musical tone signal production circuit 31 has an output terminal connected to a speaker 33 through an amplifier 32.

Figure 2A:
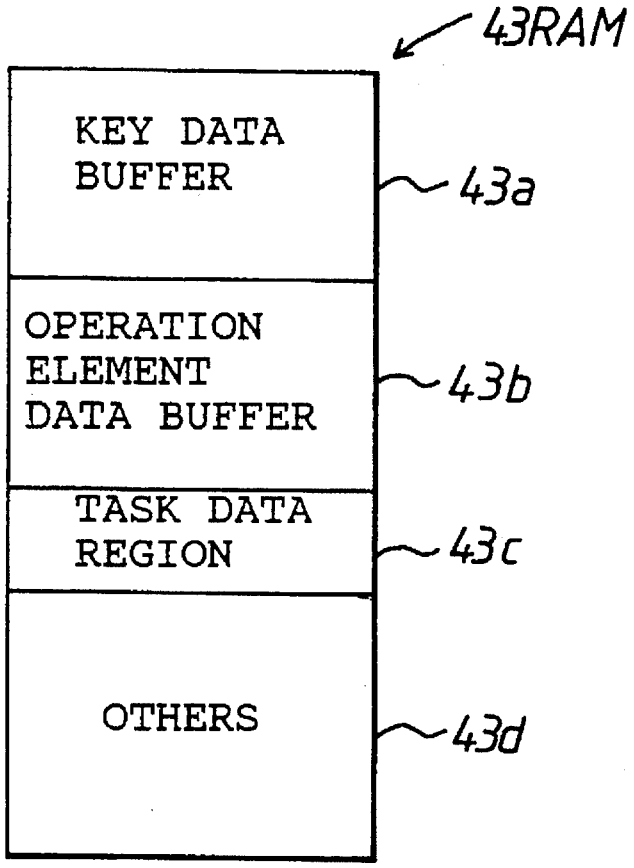
FIG. 2(A) is a map of a random access memory or RAM shown in FIG. 1.
Figure 2B:
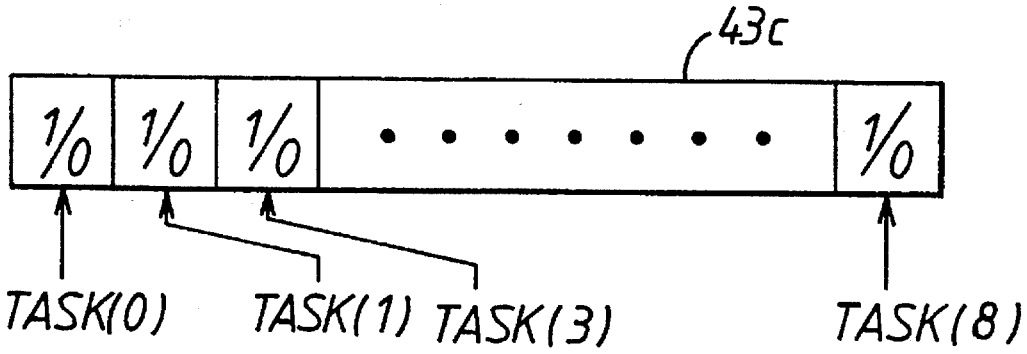
FIG. 2(B) is an illustration of a data format memorized in a task data region of the map shown in FIG. 2(A)

The microcomputer 40 includes a central processing unit or CPU 41, a read-only memory or ROM 42, a random access memory or RAM 48 and a timer 44. The CPU 41 is arranged to execute control programs shown by flow charts in FIGS. 3–11, and the ROM 42 is arranged to memorize the control programs. The RAM 43 is arranged to temporarily memorize variables necessary for execution of the control programs. As shown in FIG. 2(A), the RAM 42 is divided into a key-data buffer 43*a*, an operation clement data buffer 43*b*, a task data region 43*c* and other regions 43*d*. As shown in FIG. 2(B), the task data region 43*c* is designed to memorize task requirement flags TASK(O)–TASK(8) which represent each requirement for processing a key task a key-on task, a key-off task, an assignment task, a timer task, a key-scan task, an operation-scan task, a low frequency signal production task and a light element control task. Although the nine tasks are described as an example herein, a number of other tasks may be processed In an actual practice of the present invention. The timer 44 is adapted to produce a timer-interrupt signal at a predetermined time interval (for instance, 2.5 ms).

Hereinafter, the mode of operation of the electronic musical instrument will be described in detail with reference to the flow chart shown in FIG. 3. Assuming that the power switch has been closed, the CPU 41 is activated to initiate execution of the main control program at step 100 and initializes variables stored in the RAM 48 at step 101. After initialization at step 101, processing at step lot to 107 will be repeatedly executed by the CPU 41 as follows. During execution of the processing at step 102 to 107, the CPU 41 sets a variable j as "0" at step 102 and executes processing at step 104 to increase the variable j up to a predetermined value TMAX (8) less than the number of the tasks by addition of "1". In this instance, the CPU 41 determines at step 103 whether the task requirement flag TASK(j) designated by the variable j is "0" or not. If the task requirement flag TASK(j) is "0", the CPU 41 determines a "Yes" answer at step 103 and causes the program to proceed to step 104 for increment of the variable j. If the task requirement flag TASK(j) is "1", the CPU 41 determines a "No" answer at step 103 and causes the program to proceed to step 106. Thus, the CPU 41 resets the task requirement flag TASK(j) to "0" at step 106 and executes at step 107 a task processing routine (FIGS. 4–8 and 11) designated by the variable j. After execution of the task processing routine at step 107, the CPU 41 resets the variable j to "0" at step 102 and executes processing at step 103 to 105.

When the key board 11 is operated during execution of the main control program, the operation of key board 11 is detected at the key switch circuit 18 and the scanning circuit 16. In this instance, the CPU 41 executes processing of a program (not shown) to store key data such as keycodes indicative of the operated keys, key-off data indicative of the released keys, key-touch data indicative of touch of the depressed keys in the key data buffer 43*a*. When the operation elements of panel 12 are operated, the CPU 41 executes processing of a program (not shown) to store operation element data indicative of the operated conditions of the operation elements in the operation element data buffer 43*b*. In an actual practice of the present invention, the scanning circuits 18, 17 may be arranged to directly store the key data and the operation element data respectively in the data buffers 43*a*, 43*b*.

Figure 8:
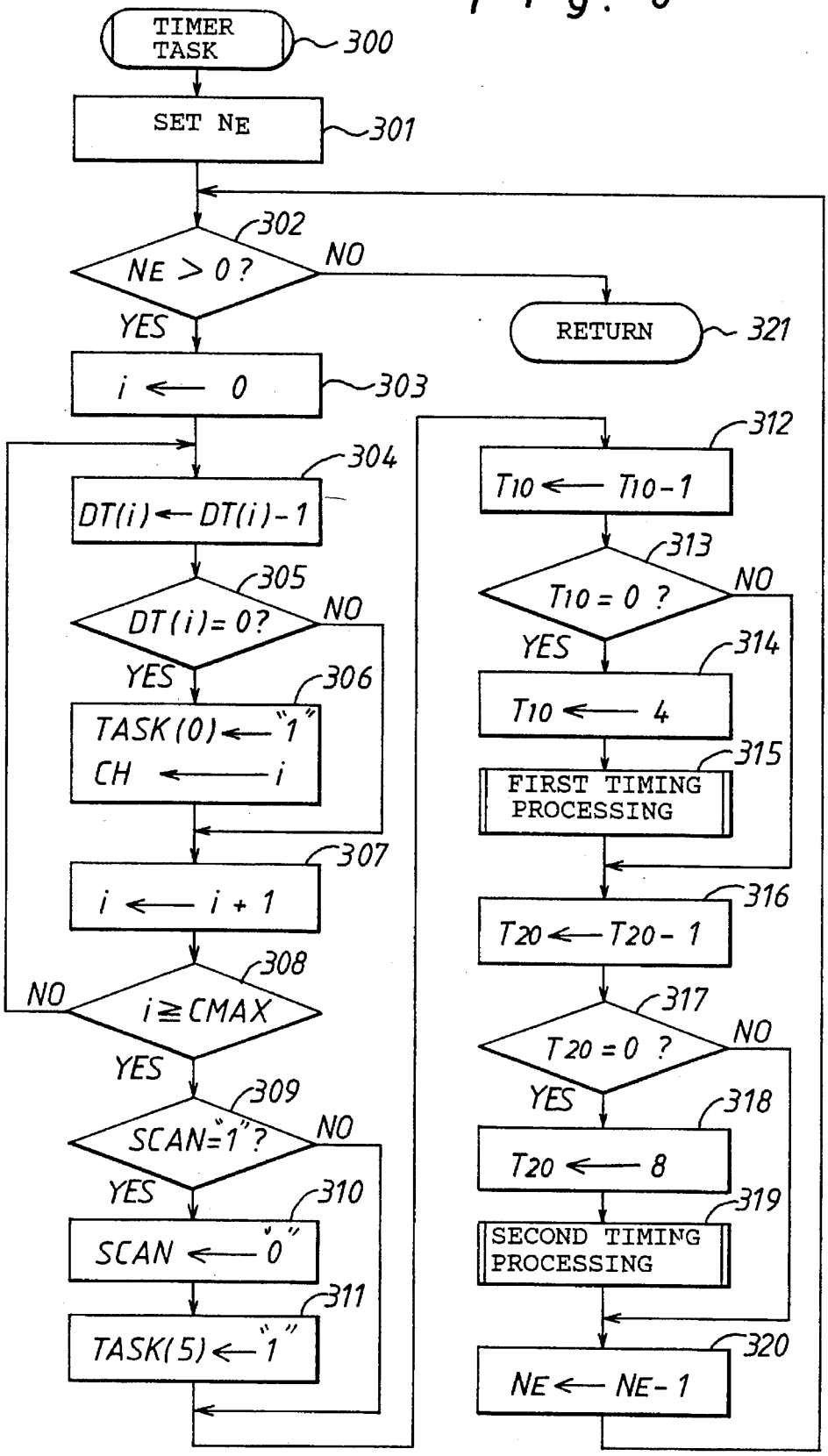
FIG. 8 is a flow chart of a timer task processing routine.

When applied with a timer-interrupt signal from the timer 44 during execution of the main control program, the CPU 41 executes a program (not shown) to change the task requirement flag TASK(4) in task data region 43*c* from "0" to "1". In this instance, the task requirement flag TASK(4) may be directly changed from "0" to "1" under control of the timer 44. When the task requirement flag TASK(4) is set as "1", the CPU 41 executes at step 107 a timer task processing routine designated by the variable J(=4). As shown in FIG. 8. the CPU 41 initiates execution of the timer task processing routine at step 300 and sets a value $N_E$ indicative of the number of execution times to a predetermined value at step 301. In this instance, the value $N_E$ is usually set as "1". In case the timer task processing routine may not be executed within a predetermined time (for instance, 2.5 ms) due to frequent processing of other tasks, the value $N_E$ will be set more than "1" so that the timer task processing is continually executed more than two times. Thus, an average frequency of the timer task processing is made one time at the predetermined time interval. When the program proceeds to step 302, the CPU 41 determines whether the value $N_E$ is more than "0" or not. Since at this stage, the value $N_E$ is set to be more than "1", the CPU 41 determines a "Yes" answer at step 302 and causes the program to proceed to step 303.

At step 303, the CPU 41 sets a variable i to "0" for designating the respective musical tone signal forming channels of the musical tone signal production circuit Subsequently, the CPU 41 repeatedly executes processing at step 304 to 308 until the variable i increases from "0" to the number CMAX of the musical tone signal forming channels by successive increment of "1" at step 307. At step 304, the CPU 41 subtracts "1" from a delay time DT(i) designated by the variable i. When the delay time DT(i) becomes "0" , the CPU 41 determines a "Yes" answer at step 305 and causes the program to proceed to step 306. At step 306, the CPU 41 sets the task requirement flag TASK(0) for the key task to "1" and memorizes the variable 1 as a channel number CH.

When the program proceeds to step 309, the CPU 41 determines whether the scan flag SCAN is "1" or not. The scan flag SCAN represents the necessity for scanning of the key switch by "1" and represents no necessity of scanning of the key switch by "0". If the scan flag SCAN is set as "1", the CPU 41 determines a "Yes" answer at step 309 and changes the scan flag SCAN from "1" to "0" at step 310. Subsequently, the CPU 41 sets the task requirement flag TASK(5) for the key-scan task to "1" at step 311.

Figure 9:
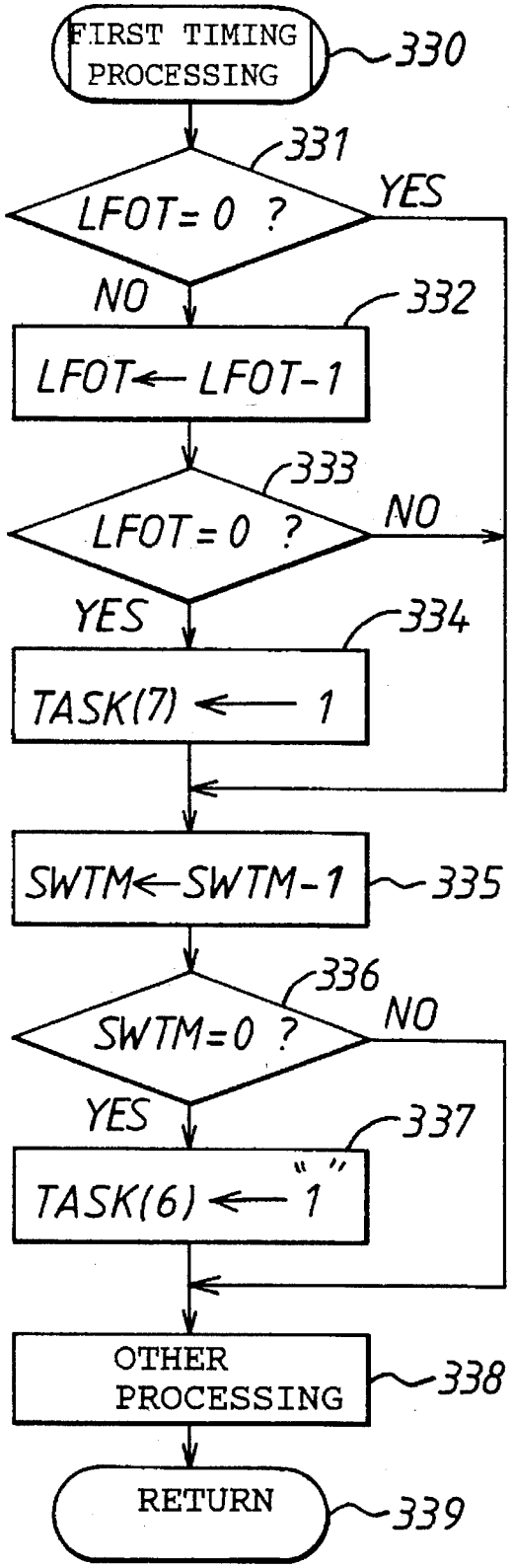
FIG. 9 is a flow chart of a first timing processing routine shown in FIG. 8.

Thereafter, the CPU 41 executes processing at step 312 to 315 during which a first timing processing routine is executed at step 315 at each time when the timer task processing routine is executed four times. As shown in FIG. 9, the CPU 41 initiates execution of the first timing processing routine at step 330 and determines at step 331 whether a low frequency signal timing LFOT is "0" or not. The low frequency signal timing LFOT is adapted to determine a sampling period of a low frequency signal for modulation of the musical tone signal to be generated. Accordingly, the signal timing LFOT of "0" means that It is not required to apply the low frequency signal to the musical tone signal for modulation thereof. If the low frequency signal timing LFOT is "0", the CPU 41 determines a "Yes" answer at step 881 and causes the program to proceed to step 335.

If the low frequency signal timing LFOT is not "0"the CPU 41 determines a "No" answer at step 331 and subtracts "1" from the signal timing LFOT by processing at step 332. At each time when the resultant of the subtraction becomes "0", the CPU 41 determines a "Yes" answer at step 338 and sets at step 334 the task requirement flag TASK(7) for the low frequency signal production task to "1". Thus, the requirement for the low frequency signal production task is conducted. Although there is not disclosed a program for processing of the low frequency signal production task, a sampling value of the low frequency signal is formed by processing of the program (not shown) and applied to the musical tone signal production circuit 31 so that the low frequency signal timing LFOT is set to a value indicative of a sampling period for forming the following sampling value.

After processing at step 331 to 334, the CPU 41 subfacts "1" from all operation element scan-timing SWTM by processing at step 335. At each time when the resultant of the subtraction at step 335 becomes "0", the CPU 41 determines a "Yes" answer at step 336 and sets at step 337 the task requirement flag TASK(6)to "1". Thus, the requirement for the operation element scan-timing task is conducted also. Although there is not disclosed a program for processing of the operation element scan-timing task, the CPU 41 reads out an operation element data from the operation element data buffer 43*b* by processing of the program (not shown) and applies control data for control of tone color, tone volume and sound effects of the musical tone slyhal to the musical tone signal production circuit 31 in accordance with the operation clement data. In this instance, the operation element scan-timing SWTM is set to a value indicative of a predetermined period for requirement of the following operation element scan-task. After processing at step 336 and 337, the CPU 41 executes other processing at step 338 and ends execution of the first timing processing routine at step 339.

Figure 10:
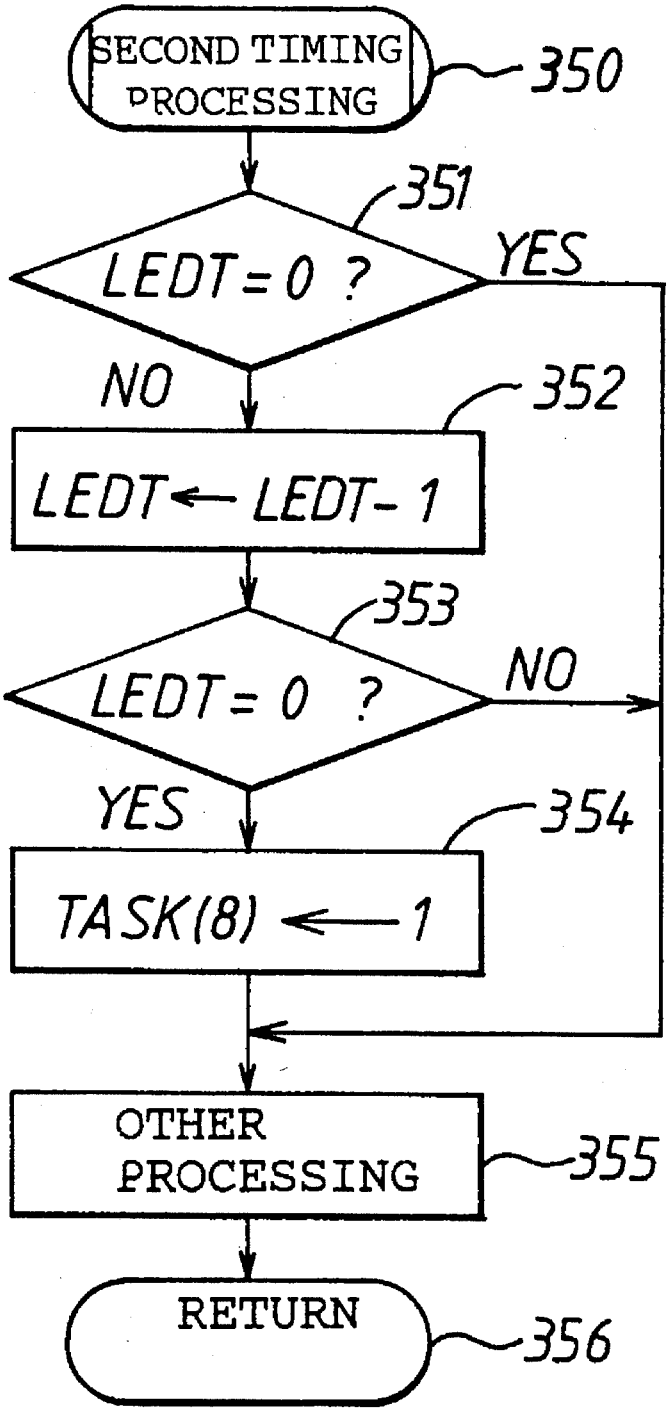
FIG. 10 is a flow chart of a second timing processing routine shown in FIG. 8.

Referring back to the program shown in FIG. 8 the CPU 41 executes the timer task processing routine by processing at step 316 to 318 after execution of the first timing processing routine and executes a second timing processing routine at step 319 at each time when the timer task processing routine is executed four times. As shown in FIG. 10, the CPU 41 initiates execution of the second timing processing routine at step 350 and determines at step 351 whether a light emitting element timing LEDT is "0" or not. The light emitting element timing LEDT is adapted to control activation or deactivation of the light emitting elements on the operation parallel 12. The light emitting element timing LEDT of "0" represents no control of the light emitting elements. If the light emitting element timing LEDT Is "0", the CPU 351 determines a "Yes" answer at step 351 and causes the program to proceed to step 355. If the light emitting element timing LEDT is not "0", the CPU 41 determines a "No" answer at step 351 and subtracts "1" from the light emitting element timing LEDT by processing at step 352. At each time when the resultant of subtraction at step 352 becomes "0", the program proceeds to step 354 where the CPU 41 sets the task requirement flag TASK(8) for the light emitting element control task to "1". Thus, the requirement of the light emitting element control task is conducted. Although there is not concretely disclosed a program for processing of the light emitting element control task, the CPU 41 applies a control signal for activating or de activating the light emitting elements to the drive circuit 15 by processing of the program (not shown) and sets the light emitting element timing LEDT to a value indicative of a predetermined period for requirement of the following light emitting element control task.

After processing at step 351 to 354, the CPU 41 executes other processing at s step 355 and ends execution of the second timing processing routine at step 356. When the program further proceeds to step 320 after processing at step 316 to 319, the CPU 41 subtracts "1" from the number of execution times $N_E$ and r returns the program to step 302. If the number of execution times $N_E$ is "0", the CPU 41 determines a "No" answer at step 302 and ends execution of the timer task processing routine at step 321. If the number of execution times $N_E$ is more than "0", the CPU 41 causes the program to proceed to step 303 for further execution of the timer task processing routine.

When the variable j becomes "5" during execution of the main control program in a condition where the task requirement flag TASK(5) has been set to "1" as described above, the CPU 41 determines a "No" answer at step 103 and resets the task requirement flag TASK(5) to "0" at step 106. At the following step 107, the CPU 41 executes a key-scan task processing routine shown in FIG. 11. In this instance, the CPU 41 initiates execution of the key-scan task processing routine at step 400 of FIG. 11 and determines at step 401 whether any key data is stored in the key-data buffer 43*a* or not. If the answer at step 401 is "No", the program proceeds to step 408 where the CPU 41 sets the key-scan flag SCAN to "1" and causes the program to proceed to step 409 for ending execution of the key-scan task processing routine. Since the key-scan flag SCAN Is set to "1" at step 408, the key-scan task processing will be executed in the following processing.

If the answer at step 401 is "Yes", the program proceeds to step 402 where the CPU 41 reads out the memorized key data from the key-data buffer 43*a* and eliminates the same from the key data buffer 43*a*. At the following step 403, the CPU 41 determines whether the read out key-data is related to depression or release of the keys. When the read out key-data is related to depression of the keys, the CPU 41 determines a "Yes" answer at step 403 and sets the task requirement flag TASK(3) For the assignment task to "1" at step 404. If the read out key-data is related to release of the keys, the CPU 41 determines a "No" answer at step 403 and sets the task requirement flag TASK(2) for the key-off task to "1" at step 405. After processing at step 404 or 405, the CPU 41 determines at step 406 whether another key-data is stored In the key-data buffer 43*a* or not. If the answer at step 406 is "No", the CPU 41 sets the key-scan flag SCAN to "1" at step 408 and ends execution of the key-scan task processing routine at step 409. If the answer at step 406 is "Yes", the CPU 41 sets the task requirement flag TASK(5) to "1" at step 407 and ends execution of the key-scan task processing routine at step 409. In this instance, the CPU 41 executes the foregoing key-scan processing routine at step 107 when the variable j becomes "5" again by execution of the main program.

Figure 7:
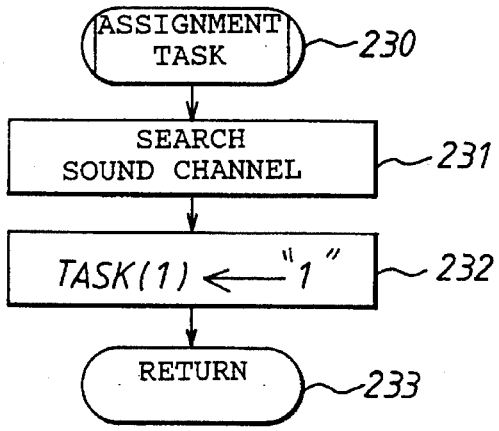
FIG. 7 is a flow chart of an assignment task processing routine.

When the task requirement flag TASK(3) is set to "1" as described above, the CPU 41 executes the assignment task processing routine at step 107 when the variable j becomes "3" by processing of the main program. As shown in FIG. 7, the CPU 41 initiates execution of the assignment task processing ng routine at step 230 and searches tim musical tone signal forming channels to find an available channel for allotment of the read out key data at step 231. Subsequently, the CPU 41 sets the task requirement flag TASK(1) to "1" at step 232 and ends execution of the assignment task processing routine at step 233.

Figure 5:
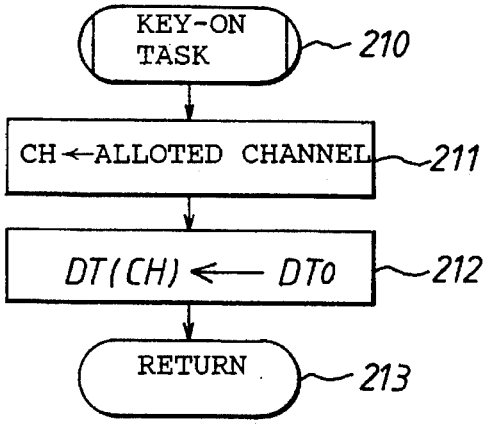
FIG. 5 is a flow chart of a key-on task processing routine.

When the task requirement flag TASK(1) is set to "1" as described above, the CPU 41 executes the key-on task processing routine at step 107 of the main control program when the variable i becomes "1". As shown in FIG. 5, the CPU 41 initiates execution of the key-on task processing routine at step 210 and sets a value indicative of the allotted musical tone signal forming channel as a channel number CH at step 211. Subsequently, the CPU 41 sets a delay time DT(CH) designated by the channel number CH to a predetermined value $DT_0$ at step 212 and ends execution of the keyon task processing routine at step 213. The delay time DT(CH) is subtracted by processing at step 304 of the timer task processing routine shown In FIG. 8. When the delay time DT(CH) becomes "0", the CPU 41 sets the task requirement flag TASK(O) to "1" by processing at step 306.

Figure 3:
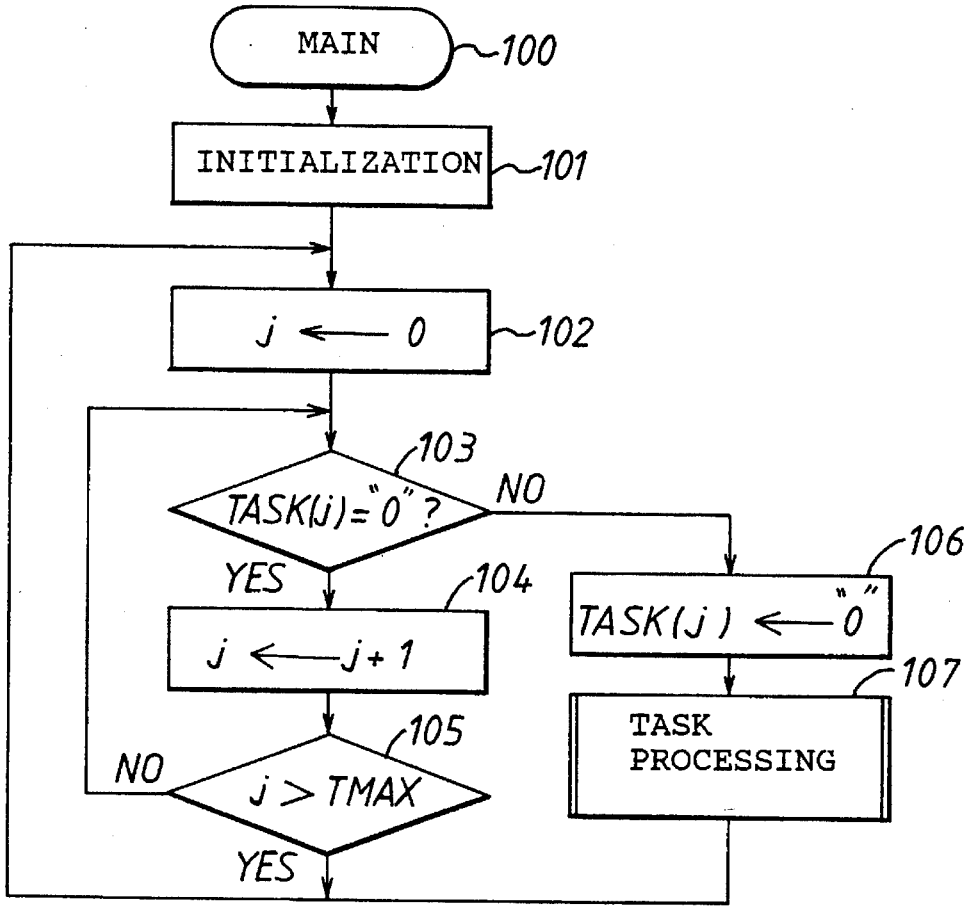
FIG. 3 is a flow chart of a main control program executed by a microcomputer shown in FIG. 1.
Figure 4:
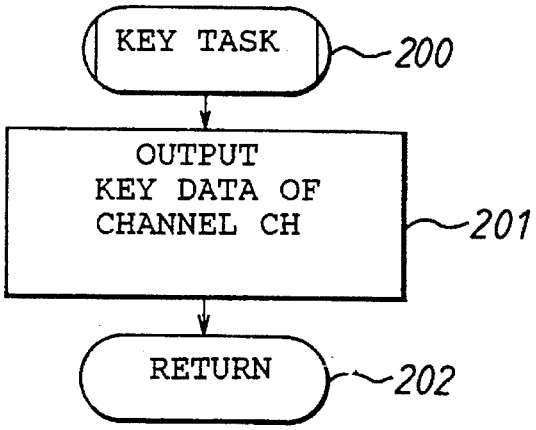
FIG. 4 is a flow chart of a key task processing routine shown in FIG. 3.

In this instance, the CPU 41 executes the key task processing routine at step 107 when the variable j becomes "0" in the main control program of FIG. 3. As shown in FIG. 4, the CPU 41 initiates execution of the key task processing routine at step 200 and applies key data allotted in the subtracted channel CH to the musical tone signal production circuit 31 at step 201. Since the key data is related to depression of the key, the musical tone signal production circuit 31 produces therefrom a musical tone signal designated by the key data at the musical tone signal forming channel designated by the channel CH. Accordingly, when a key on keyboard 11 is depressed, the musical tone signal is produced after lapse of the predetermined time $DT_0$. If the predetermined time $DT_0$ is set as "1", the musical tone signal will be produced immediately after depression of the key by processing at step 804–806 of the timer task processing routine shown in FIG. 8.

Figure 6:
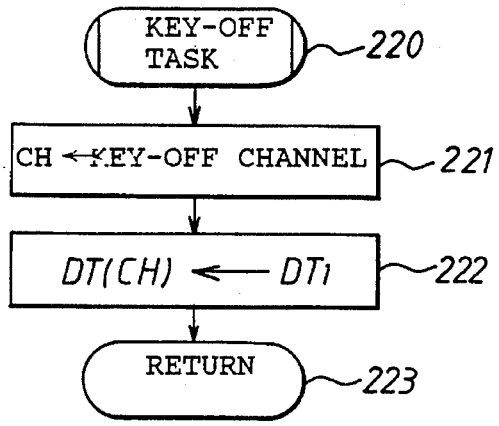
FIG. 6 is a flow chart of a key-off task processing routine.
Figure 11:
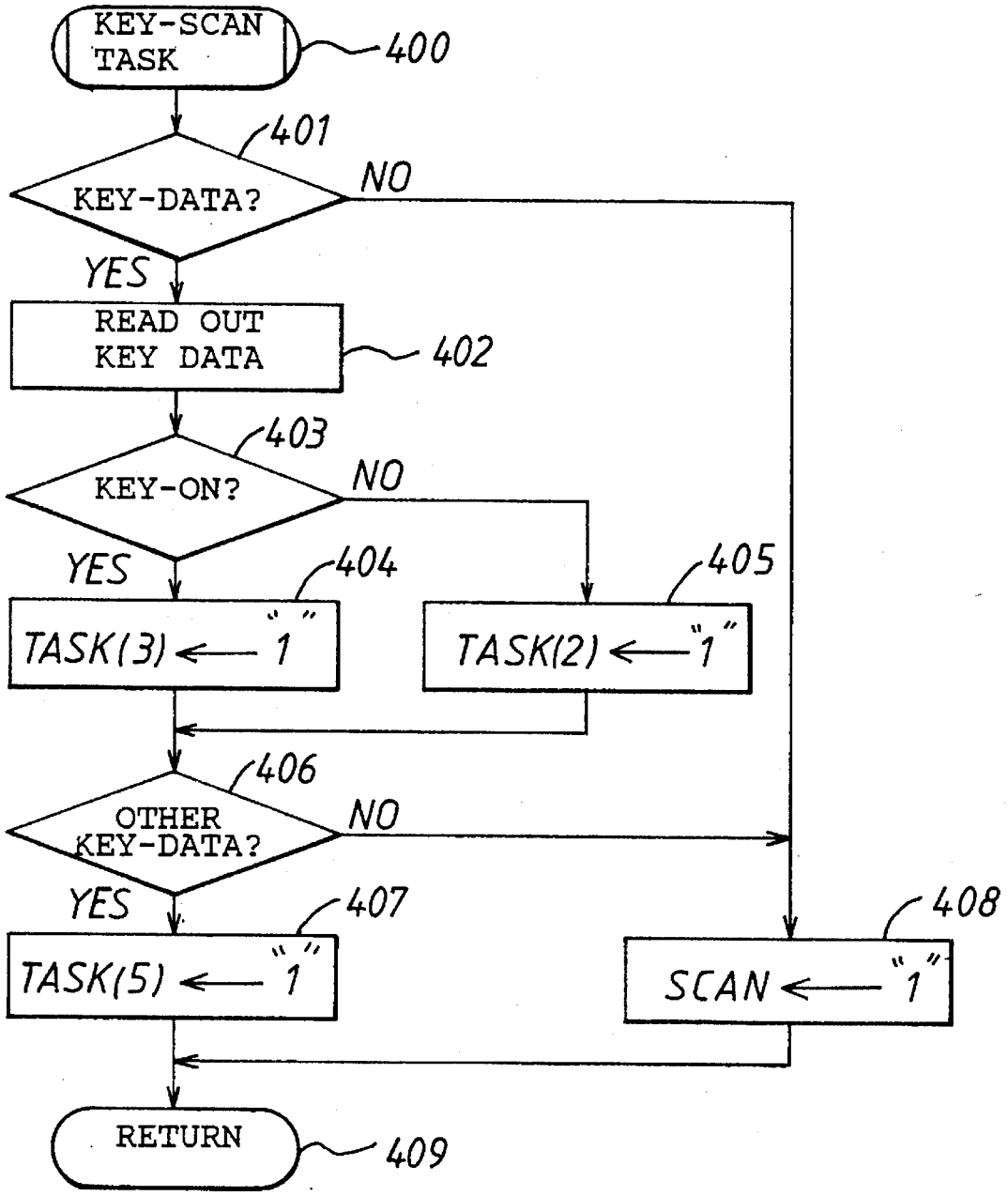
FIG. 11 is a flow chart of a key-scan task processing routine.

In a condition where time task requirement flag TASK(2) is set as "1" by processing at step 405 of the key-scan task processing routine shown in FIG. 11, the CPU 41 executes the key-off task processing routine at step 107 of the main control program when the variable 1 becomes "2". As shown in FIG. 6, the CPU 41 initiates execution of the key-off task processing routine at step 220. At the following lowing step 221, the CPU 41 searches the allotted musical tone signal forming channel for the read out key data and sets a value indicative of the same as a channel number CH. Subsequently, the CPU 41 sets a delay time DT(CH) designated by the channel number CH to a predetermined value $DT_1$ at step 222 and ends execution of the key-off task processing routine at step 228. The delay time DT(CH) is subtracted by execution of the timer task processing routine as described scribed above. When the delay time DT(CH) becomes "0", the CPU 41 executes the key task processing routine shown in FIG. 4. In this instance, the CPU 41 applies key data allotted in the subtracted channel CH to the musical tone signal production circuit 31 at step 201. Since the key data is related to release of the keys, the musical tone signal production circuit 81 ceases production of the musical tone signal at the musical tone signal forming channel designated by the channel CH. Accordingly, when the depressed keys on keyboard 11 are released, the musical tone signal disappears upon lapse of the predetermined time $DT_1$. If the predetermined time $DT_1$ is set as "1", the CPU 41 ceases production of the musical tone signal immediately after release of the depressed keys by processing at step 304 to 306.

From the above description, it will be understood that in operation of the preferred embodiment either one or more task requirement flags TASK(1)–(8) is set as "1" in accordance with operated conditions of the keyboard 11 and operation panel 12 and control conditions of production of the musical tone signal such that each processing of the tasks is required in sequence on a basis of the set task requirement flags (0)–(8) during execution of the main control program and executed to control production of the musical tone signal. Since the task requirement flags TASK(0)–(8) represent respective requirements for the key task, the key-on task, the key-off task, the assignment task, the timer task, the key-scan task, the operation element scan task, the low frequency signal production task and the light emitting element task in sequence, the priority order of the tasks to be processed at a high speed in response to operation of the key board 11 can be set higher than that of the tasks to be processed at a relatively low speed in response to operation of the operation panel 12. Accordingly, even when plural keys are depressed or released in a short time, any delay does not occur in production or disappearance of musical tone signals responsive to the operated keys. In case there is not any requirement of tasks, unnecessary processing of the programs can be avoided to enhance the production and control efficiency of the musical tone signals by computer 40.

If in the preferred embodiment other key data are remained In the key data buffer 43*a* after processing at step 401–405 of the key-scan task processing routine, the CPU 41 determines a "Yes" answer at step 406 and sets again. the task requirement flag TASK(5) to "1" at step 405. In this instance, the key-scan task processing routine is continually executed to eliminate a delay in processing caused by operation of the key board 11.

What is claimed is:

1. An electronic musical instrument having a plurality of first operation elements arranged to be operated for designating a tone pitch of a musical tone to be produced, a plurality of second operation elements arranged to be operated for selecting a tone color of the musical tone, and a musical tone signal production circuit to be applied with a first data indicative of operation of the first operation elements and a second data indicative of operation of the second operation elements, comprising:

a timer for generating a timer-interrupt signal at a predetermined time interval, first setting means for setting a first task requirement flag for processing one of the first data in response to the timer-interrupt signal from said timer and for subsequently setting again the first task requirement flag for processing the remaining first data in response to the timer-interrupt signal from said timer in a condition where the previously set first task requirement flag is being maintained;

second setting means for setting a second task requirement flag for processing the second data when the first task requirement flag has been set plural times; and means for successively processing the plurality of first data based on the first task requirement to apply the processed first data to said musical tone signal production circuit and for processing the second data based on the second task requirement flag to apply the processed second data to said musical tone signal production circuit.

2. An electronic musical instrument as recited in claim 1, wherein said first operation elements are in the form of a plurality of keys on a keyboard, and said second operation elements are in the form a plurality of operation elements provided on an operation panel for selecting a tone color of the musical tone and a sound effect to be applied to the musical tone.

3. An electronic musical instrument having a plurality of first operation elements arranged to be operated for designating a tone pitch of a musical tone to be produced, a plurality of second operation elements arranged to be operated for selecting a tone color of the musical tone, and a musical tone signal production circuit to be applied with a plurality of first data indicative of operation of the first operation elements and a second data indicative of operation of the second operation elements, comprising:

a timer for generating a timer-interrupt signal at a predetermined time interval;

memory means for storing a plurality of first task requirement flags representing each requirement for processing a key task, a timer task and a key-scan task for the first data and a second task requirement flag representing requirement for processing an operation-scan task for the second data;

first setting means for setting one of the first task requirement flags for the key task in response to the timer-interrupt signal from the said timer and for subsequently setting the remaining first task requirement flags for the timer task and the key-scan task in sequence in response to the timer-interrupt signal from said timer;

second setting means for successively setting the second task requirement flag for the operation-scan task when the first task requirement flag for the timer task has been set plural times; and means for successively processing the plurality of first data based on the first task requirement flags to apply the processed first data to said musical tone signal production circuit and for processing the second data based on the second task requirement flag to apply the processed second data to said musical tone signal production circuit.

4. An electrical musical instrument having a plurality of first operation elements arranged to be operated for designating tone pitch of a musical tone to be produced, a plurality of second operation elements arranged to be operated for selecting a tone color of the musical tone, and a musical tone signal production circuit to be applied with a plurality of first data indicative of operation of the first operation elements and a second data indicative of operation of the second operation elements, comprising:

a timer for generating a timer-interrupt signal at a predetermined time interval;

memory means for storing a plurality of first task requirement flags representing each requirement for processing a key task, a key-on task, a key-off task, an assignment task, a timer task and a key-scan task for the first data and a second task requirement for processing an operation-scan task for the second data;

first setting means for setting one of the first task requirement flags for the key task in response to the timer-interrupt signal from said timer and for subsequently setting the remaining first task requirement flags for the key-on task, the key-off task, the assignment task, the timer task and the key-scan task in sequence in response to the timer-interrupt signal from said timer;

second setting means for successively setting the second task requirement flag for the operation-scan task when the first task requirement flag for the timer task has been set plural times; and means for successively processing the plurality of first data based on the first task requirement flags to apply the processed first data to said musical tone signal production circuit and for processing the second data based on the second task requirement flag to apply the processed second data to said musical tone signal production circuit.

5. An electronic musical instrument having a plurality of first operation elements arranged to be operated for designating tone pitch of a musical tone to be produced, a plurality of second operation elements arranged to be operated for selecting a tone color of the musical tone, and a musical tone signal production circuit to be applied with a plurality of first data indicative of operation of the first operation elements and a second data indicative of operation of the second elements, comprising:

a timer for generating a timer-interrupt signal at a predetermined time interval;

memory means for storing a plurality of first task requirement flags representing each requirement for processing a key task, a timer task and a key-scan task for the first data and a plurality of second task requirement flags representing each requirement for processing an operation-scan task and a low frequency signal production for the second data;

first setting means for setting one of the first task requirement flags for the key task in response to the timer-interrupt signal from said timer and for subsequently setting the remaining first task requirement flags for the timer task and the key-scan task in sequence in response to the timer-interrupt signal from said timer;

second setting means for successively setting the second task requirement flags for the operation-scan task and the low frequency signal production task when the first task requirement flag for the timer task has been set plural times; and means for successively processing the plurality of first data based on the first task requirement flags to apply the processed first data to said musical tone signal production circuit and for processing the second data based on the second task requirement flag to apply to the processed second data to said musical tone signal production unit.

* * * * *